US009525226B2

(12) United States Patent
Tamaki

(10) Patent No.: US 9,525,226 B2
(45) Date of Patent: Dec. 20, 2016

(54) ELECTRICAL CONNECTOR

(71) Applicant: Hirose Electric Co., Ltd., Tokyo (JP)

(72) Inventor: Shoichiro Tamaki, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 15/054,231

(22) Filed: Feb. 26, 2016

(65) Prior Publication Data

US 2016/0268717 A1 Sep. 15, 2016

(30) Foreign Application Priority Data

Mar. 13, 2015 (JP) ..... 2015-051142

(51) Int. Cl.
*H01R 13/15* (2006.01)
*H01R 12/72* (2011.01)
*H01R 13/639* (2006.01)

(52) U.S. Cl.
CPC ..... *H01R 12/721* (2013.01); *H01R 13/639* (2013.01)

(58) Field of Classification Search
CPC ..... H01R 23/684; H01R 23/6833; H01R 23/7068
USPC ..... 439/260, 267, 633, 637, 161, 495
See application file for complete search history.

(56) References Cited

U.S. PATENT DOCUMENTS 6,669,503 B2 * 12/2003 Hirose ..... H01R 12/88 439/495
7,654,829 B1 * 2/2010 Chuang ..... H01R 12/79 439/67
8,651,885 B2 * 2/2014 Ashibu ..... H01R 12/774 439/328
8,662,916 B2 * 3/2014 Ashibu ..... H01R 12/88 439/260
2015/0200473 A1 * 7/2015 Chiang ..... H01R 12/79 439/67

FOREIGN PATENT DOCUMENTS

JP H09245910 A 9/1997
JP H10270130 A 10/1998
JP 2008-192574 A 8/2008
JP 2015-043299 A 3/2015

* cited by examiner

*Primary Examiner* — Phuongchi T Nguyen
(74) *Attorney, Agent, or Firm* — Kubotera & Associates, LLC

(57) ABSTRACT

An electrical connector is to be connected to a flat conductive member. The electrical connector includes a housing including a receiving portion for receiving the flat conductive member; terminals arranged in the housing in a terminal arrangement direction; and a movable member rotatable between an open position and a close position relative to the housing. The movable member includes an engaging portion for engaging an engaged portion when the movable member is situated at the close portion. The movable member includes a pressure receiving portion for abutting against the engaged portion when the movable member is situated at the open portion. The movable member includes a passing allowing space between the engaging portion and the pressure receiving portion for allowing the engaged portion to pass through. The engaged portion passes through the passing allowing space when the movable member is rotated toward the close position.

6 Claims, 7 Drawing Sheets

ELECTRICAL CONNECTOR

BACKGROUND OF THE INVENTION AND RELATED ART STATEMENT

The present invention relates to an electrical connector to be connected to a flat conductive member. More specifically, the present invention relates to an electrical connector to be mounted on a mounting surface of a flat conductive member such as a circuit board and the like, so that the electrical connector is connected to the flat conductive member.

Patent Reference has disclosed a conventional electrical connector to be connected to a flat conductive member. The flat conductive member is inserted and pulled in a front-and-back direction, which is a direction horizontal to a mounting surface of a circuit board.

The conventional electrical connector disclosed in Patent Reference includes a housing, a plurality of terminals, and a movable member (a shell). The housing extends along the mounting surface in a direction perpendicular to the front-and-back direction as a longitudinal direction thereof. The terminals are arranged in the longitudinal direction as an arrangement direction of the terminals, and are held in the housing. The movable member is supported on the housing, so that the movable member is rotatable around a rotational center thereof between an open position and a close position relative to the housing. The flat conductive member is to be inserted into the conventional electrical connector while the movable member is situated at the close position.

Patent Reference: Japanese Patent Application Publication No. 2008-192574

In the conventional electrical connector, the housing further includes a receiving portion to receive the flat conductive member as a space opened backward. The movable member is supported on the housing at a position close to a rear end of the movable member with the rotational center at both ends thereof in the terminal arrangement direction.

In the conventional electrical connector, each of the terminals (contacts) includes two types of contacts, namely an upper contact and a lower contact. The upper contact contacts with an upper surface of the flat conductive member, and the lower contact contacts with a lower surface of the flat conductive member, respectively, through an elastic force. The upper contact and the lower contact are provided at positions so as to tightly press the flat conductive member regardless of the open/closed state of the movable member. The upper contact and the lower contact tightly press the flat conductive member with the elastic force once the flat conductive member starts entering the conventional electrical connector.

In the conventional electrical connector, the movable member has a flat spring portion. The flat spring portion is formed through notching a part of the movable member. The flat spring part has an engaging protrusion. When the movable member is situated at the close position, and the flat conductive member is inserted up to a certain position against the elastic force of the flat spring-like part, the engaging protrusion enters an engaging hole formed in the flat conductive member, so that the flat conductive member is prevented from coming off.

In the conventional electrical connector, when the flat conductive member is pulled out from the conventional electrical connector, the movable member is rotated toward the open position, so that the engaging protrusion is disengaged from the engaging hole and the flat conductive member is removed.

According to the conventional electrical connector disclosed in Patent Reference, when the flat conductive member is pulled out while the movable member (the shell) is rotated to the close position, the movable member stops at the open position unless the movable member is rotated in a specific way. However, when the movable member stays being lifted at the open position, the movable member becomes an obstacle for connecting other electronic components on the circuit board, on which the conventional electrical connector is mounted. In addition, when the flat conductive member is inserted into the conventional electrical connector again, it is necessary to rotate the movable member to the close position. When it is necessary to connect a large number of electronic components, it is necessary to rotate the movable member to the close position each time, thereby making it difficult to simplify the connection operation, and to reduce an amount of work as much as possible.

In view of the above-described problems, an object of the present invention is to provide an electrical connector to be connected to a flat conductive member capable of solving the problems. In the electrical connector, a movable member is configured to automatically rotate back from the open position to the close position after the flat conductive member is pulled out from the electrical connector.

Further objects and advantages of the present invention will be apparent from the following description of the present invention.

SUMMARY OF THE INVENTION

In order to attain the objects described above, according to a first aspect of the present invention, the electrical connector of the present invention is an electrical connector for a flat conductive member, which extends in a front-and-back direction. The electrical connector of the present invention includes a housing, a plurality of terminals, and a movable member.

According to the first aspect of the present invention, the housing has a receiving portion to insert the flat conductive member in the front-and-back direction, which is a space formed to open at least backward. The terminals are arranged and held in the housing in a direction perpendicular to the front-and-back direction as an arrangement direction of the terminals. The movable member is supported on the housing or the terminals, so as to be rotatable around the rotational center thereof between the open position and the close position relative to the housing. In addition, the movable member has an engaging portion at a position outside the arrangement range of the terminals in the terminal arrangement direction, so as to be able to engage with the engaged portion, which is formed in the flat conductive member, at the close position in the direction to pull out the flat conductive member.

According to the first aspect of the present invention, in the electrical connector for a flat conductive member, the movable member has a pressure receiving portion. When the movable member is situated at the open position, the engaged portion of the flat connector receives a backward force to pull out, and abuts against the pressure receiving portion. In addition, there is formed a space between the engaging portion and the pressure receiving portion to allow the engaged portion pass through. In the process that the movable member receives the abutting force at the pressure receiving portion and is rotated to the close position, the space to allow the engaged portion to pass through is present in the passing path of the engaged portion over the whole range in the pull-out direction. As a result, the engaged portion can pass through the space in the pull-out direction.

According to the first aspect of the present invention, in the connector having the above-described configuration, in order to pull out the flat conductive member, first the movable member is rotated to the close position so as to be able to pull out, and then the flat conductive member is pulled out backward. Receiving the pull-out force, the flat conductive member applies the abutting force to the pressure receiving portion of the movable member. With the rotational force, the movable member is rotated to the close position.

In the rotational process of the movable member, the space to allow passing of the movable member is moved to a position on the passing path of the engaged portion over the whole area in the pull-out direction of the flat conductive member. Therefore, the engaged portion of the flat conductive member, which is pulled backward, is allowed to pass backward in the space to allow passing. As a result, the flat conductive member is pulled out. The pulling out action is made in a short amount of time. Therefore, the movable member continuously is rotated to the close position. Accordingly, the pulling out of the flat conductive member and the rotation of the movable member to the close position can be conducted as a series of actions.

According to a second aspect of the present invention, the pressure receiving portion of the movable member may be provided at a position so as to generate moment that rotates the movable member around the rotational center towards the close position by the abutting force from the engaged portion of the flat conductive member.

According to a third aspect of the present invention, an urging member can be formed as a part of the housing or is attached to the housing. In addition, there an urged portion can be provided for engaging with the urging member and receiving an urged force. With the configuration, when the movable member is within the rotational range of a certain angle from the open position, the urged portion receives the urged force that maintains the movable member at the open position. When the movable member is moved over the rotational range of the certain angle from the open position, the urged portion receives the urged force, which is directed to the close position, from the urging member.

According to the third aspect of the present invention, when the movable member is situated at the open position, even if the movable member receives some external force, or even if the movable member is about to rotate to the close position within the certain angle, the movable member returns to the open position by the urged force and maintains being at the open position. Upon intentionally pulling out the flat conductive member, the pull-out force significantly works. Therefore, the movable member is rotated more than the certain angle, and with the urged force, the movable member moves towards the close position. Therefore, even after pulling out the flat conductive member, the movable member is surely brought back to the close position by the urged force.

Alternatively, according to a fourth aspect of the present invention, in the process of inserting the flat conductive member frontward, the engaged portion of the flat conductive member passes the space to allow the movable member to pass and passes the engaging portion. Then, the movable member receives the urged force from the urging member and thereby being rotated to the close position. As a result, the engaging portion is brought to a position to be able to engage with the engaged portion in the direction to pull out the flat conductive member.

According to the fourth aspect of the present invention, upon inserting the flat conductive member, the movable member receives the urged force, which is directed to the close position, by the urging member. Once the engaged portion of the flat conductive member enters the space that allows passing, the engaged portion is within the space. The movable member is temporarily restricted from being rotated to the close position. When the flat conductive member further enters forward, the engaged portion passes the passage-allowing space, and comes in front of the engaging portion.

At this point, since there is no factor to restrict the rotation of the movable member to the close position, the movable member is rotated again to the close position by the urged force. As a result, the engaging portion of the movable member is located right behind the engaged portion of the flat conductive member, and thereby the flat conductive member is prevented from being pulled out.

According to a fifth aspect of the present invention, the engaging portion may have an engaging surface. The engaging surface can engage with the engaged portion of the flat conductive member at the close position. The engaging surface is formed as a slanted surface that exerts a force, which works in a direction to be away from the passage-allowing space along the engaging surface, when the engaged portion engages with the engaging surface.

According to the fifth aspect of the present invention, with the above-described configuration, after the flat conductive member is inserted into the electrical connector, when the engaged portion of the flat conductive member engages with the engaging portion in the pull-out direction, the engaged portion of the flat conductive member receives the force, which works in the direction to be away from the passage-allowing space along the engaging surface of the engaging portion. In other words, the engaged portion receives the force, which works in the direction opposite to the direction to come off from the engaging portion, and thereby more strongly engages with the engaging portion.

According to a sixth aspect of the present invention, the pressure receiving portion has a pressure receiving surface that can contact with the engaged portion of the flat conductive member at the open position in the pull-out direction of the flat conductive member. The pressure receiving surface may be formed as a slanted surface, so that the force, which is directed to the passage-allowing space along the pressure receiving surface, is applied on the engaged portion, when the engaged portion abuts against the pressure receiving surface.

According to the sixth aspect of the present invention, with the above-described configuration, upon pulling out the flat conductive member, when the engaged portion of the flat conductive member abuts against the pressure receiving portion in the pull-out direction, the force, which is directed to the passage-allowing space along the pressure receiving surface of the pressure receiving surface, is applied on the engaged portion of the flat conductive member.

In other words, even if the engaged portion is rotated to the close position, the engaged portion will not be dragged by the pressure receiving portion in a direction to be away from the passage-allowing space. Therefore, it is achievable to securely bring the passage-allowing space to the engaged portion, so as to let the engaged portion pass the passage-allowing space towards the pull-out direction, and thereby to easily pull out the flat conductive member.

According to the present invention, upon pulling out the flat conductive member, the pressure receiving portion of the movable member at the open position abuts against the engaged portion of the flat conductive member. With the abutting force, the movable member is rotated to the close position. During this rotation, the passage-allowing space of the movable member comes to on the path of the engaged portion of the flat conductive member over the whole area in the pull-out direction of the flat conductive member. At this point, the engaged portion passes the passage-allowing space backward, and thereby it is possible to pull out the flat conductive member. In addition, after pulling out, the movable member is continuously rotated and reaches the close position. As a result, an operator does not have to move the movable member back from the open position to the close position after pulling out the flat conductive member from the electrical connector.

BRIEF DESCRIPTION OF THE DRAWINGS

FIGS. 3(A) through 3(D) are sectional views showing the electrical connector for a flat conductive member before the flat conductive member is inserted into the electrical connector taken along a surface perpendicular to an arrangement direction of terminals of the electrical connector according to the embodiment of the present invention, wherein FIG. 3(A) is a view taken at a signal terminal (along a line A in FIG. 1), FIG. 3(B) is a view taken at a grounding terminal (along a line B in FIG. 1), FIG. 3(C) is a view taken at a passage-allowing space (along a line C in FIG. 1), and FIG. 3(D) is taken at an energizing metal fitting (along a line D in FIG. 1);

DETAILED DESCRIPTION OF THE PREFERRED EMBODIMENTS

Hereunder, an embodiment of the present invention will be described with reference to the accompanying drawings.

Figure 1:
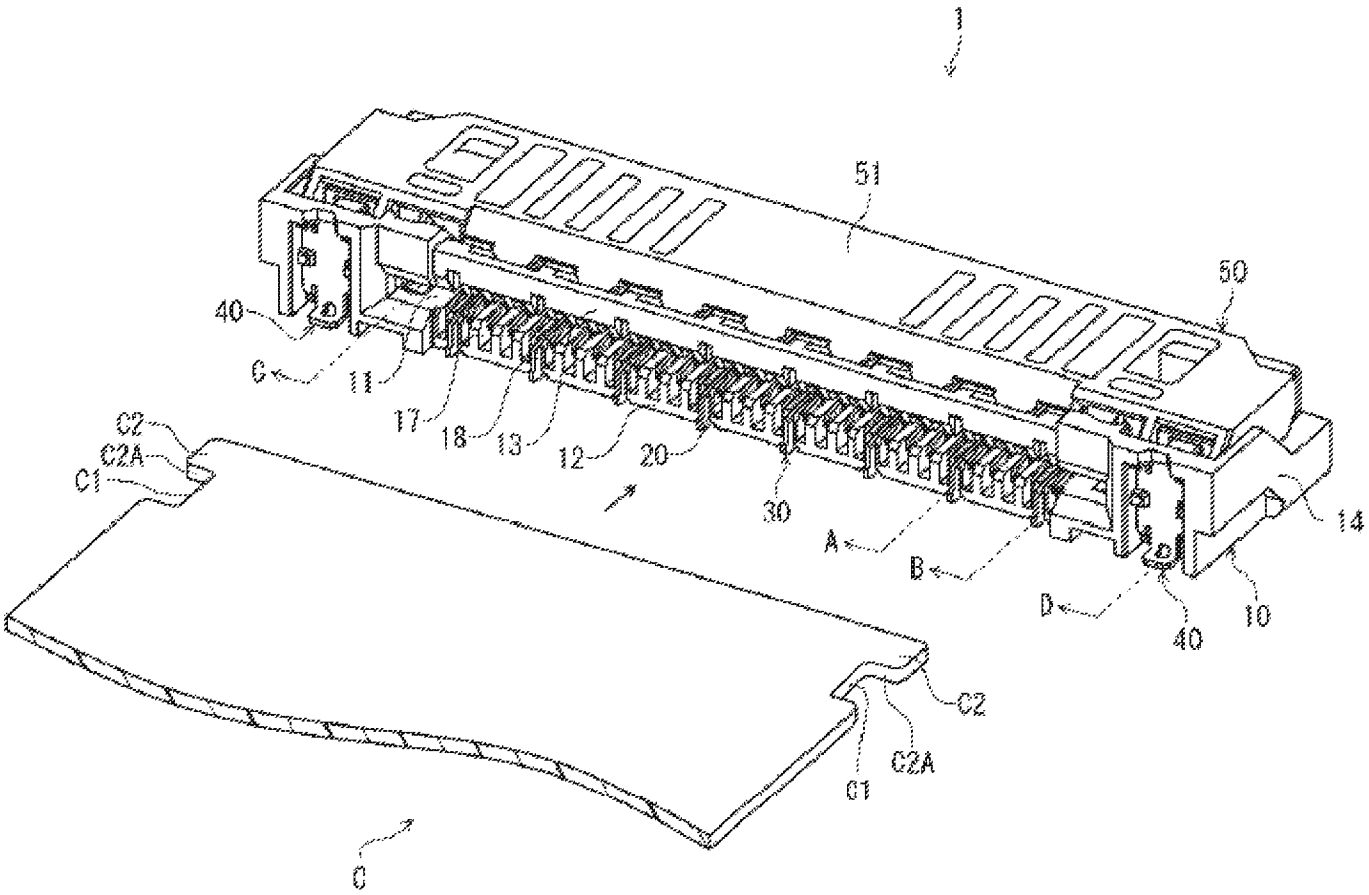
FIG. 1 is a perspective view showing an electrical connector for a flat conductive member with a flat conductive member according to an embodiment of the present invention.
Figure 2:
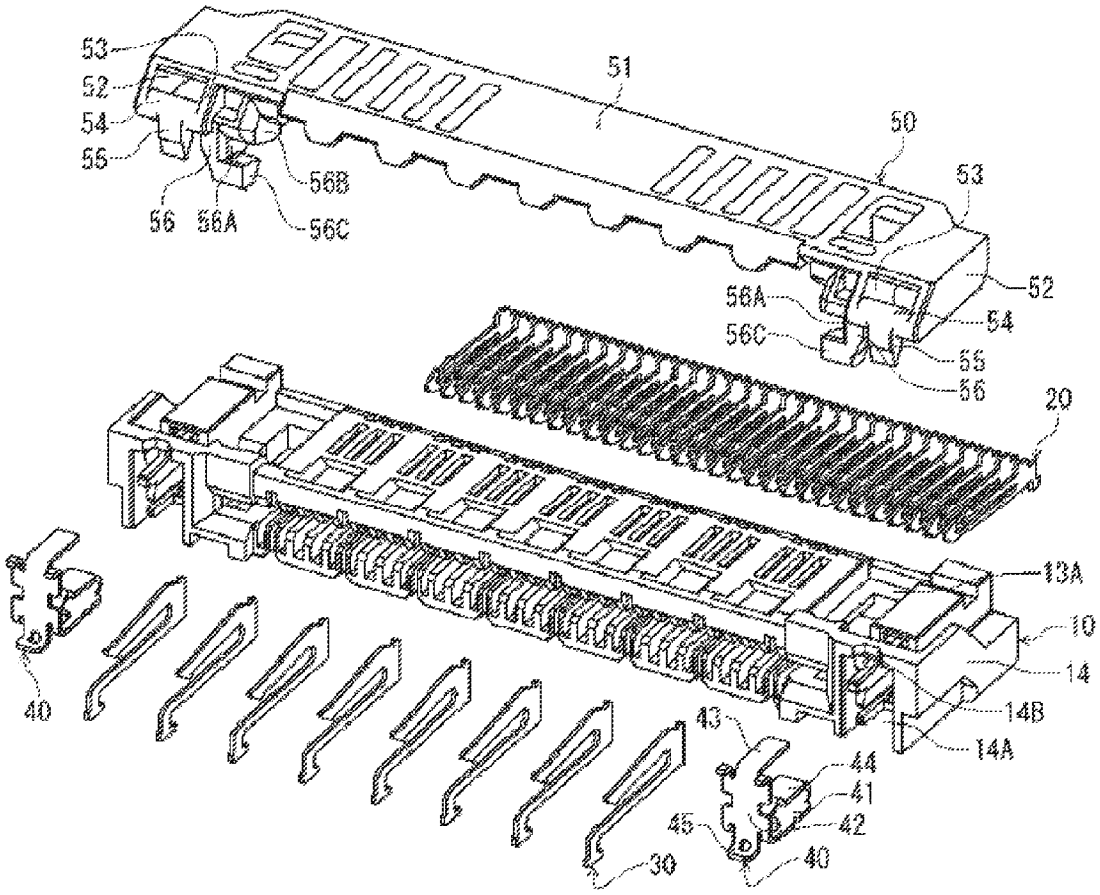
FIG. 2 is an exploded view showing the electrical connector for a flat conductive member according to the embodiment of the present invention.

FIG. 1 is a perspective view showing an electrical connector 1 for a flat conductive member C (hereinafter, referred to as "connector 1") and the flat conductive member C according to an embodiment of the present invention. FIG. 2 is an exploded view showing the connector 1.

Figure 3:
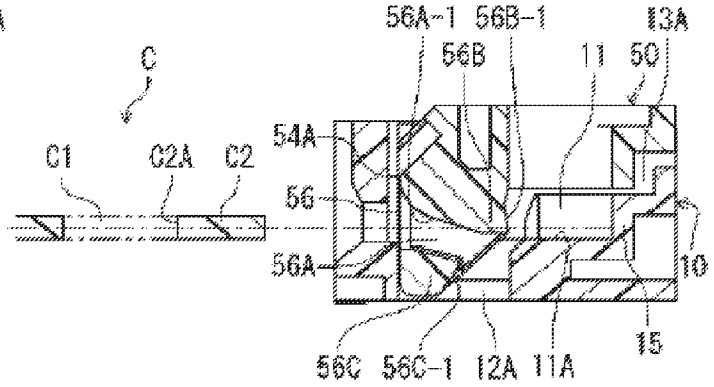
Figure 3:
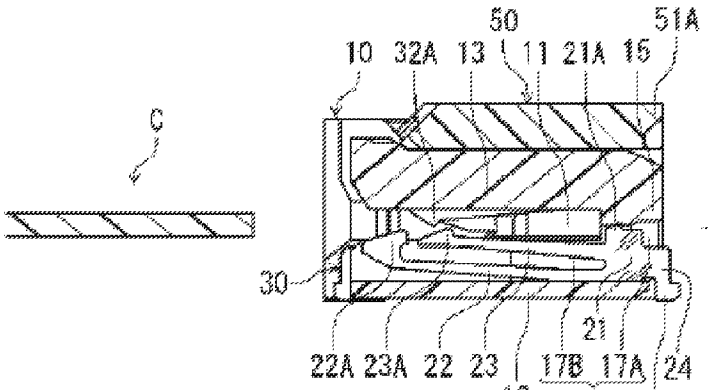
Figure 3:
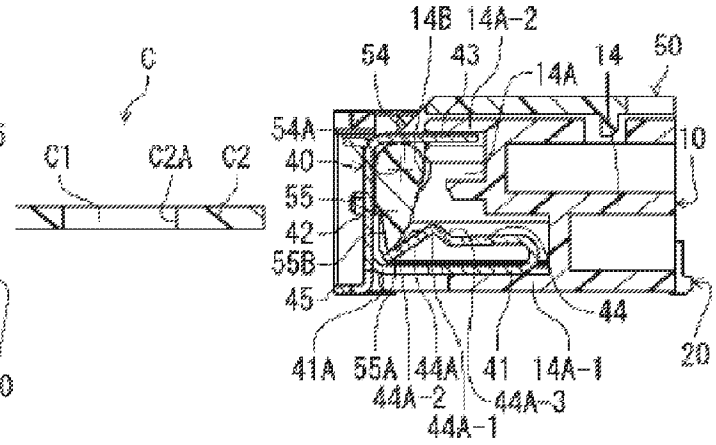
Figure 3:
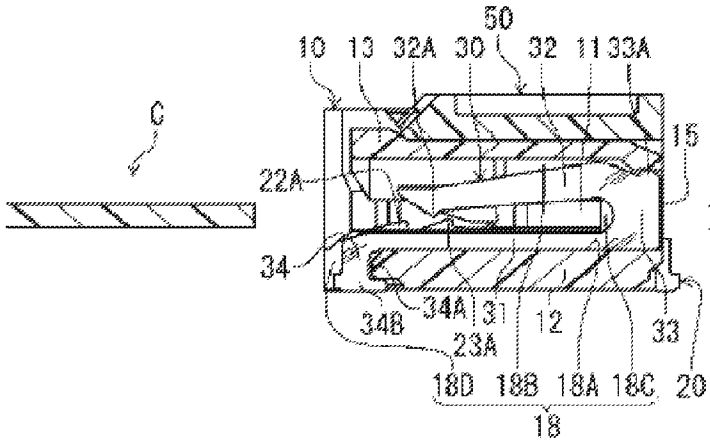

FIGS. 3(A) through 3(D) are sectional views showing the electrical connector 1 before the flat conductive member C is inserted into the electrical connector 1 taken along a surface perpendicular to an arrangement direction of terminals of the electrical connector 1 according to the embodiment of the present invention. More specifically, FIG. 3(A) is a sectional view showing the electrical connector 1 taken at a signal terminal (along a line A in FIG. 1). FIG. 3(B) is a sectional view showing the electrical connector 1 taken at a ground terminal (along a line B in FIG. 1). FIG. 3(C) is a sectional view showing the electrical connector 1 taken at a passage-allowing space (along a line C in FIG. 1). FIG. 3(D) is a sectional view showing the electrical connector 1 taken at an energizing metal fitting (along a line D in FIG. 1). It should be noted that, in FIG. 3(C), the phantom lines show upper surfaces and lower surfaces of the flat conductive member C at a notch C1 thereof (described later).

In the embodiment, the connector 1 is first disposed on a mounting surface of a circuit board (not illustrated). With the flat conductive member C being connected thereto, the flat conductive member C can electrically connect to the circuit board. Here, the "circuit board" means a flat mounting member, on which a circuit portion is formed to connect to terminals of the connector. Such mounting member may include a flat member that has low rigidity and is soft similarly to the flat conductive member C, as well as a flat member having high rigidity.

Moreover, according to the embodiment, "an arrangement range of terminals" means a range where a plurality of terminals is continuously arranged at certain intervals. According to the connector 1 of the embodiment, as well shown in FIGS. 1 and 2, signal terminals 20 and grounding terminals 30, which will be described later, are arranged at certain intervals, whereby one arrangement range of terminals is formed. Hereunder, when it is not necessary to specify whether terminals are the signal terminals 20 or the grounding terminals 30, they are generally referred to as "terminals 20 and 30" for convenience of explanation.

As shown in FIG. 1, the flat conductive member C has a strip-like shape that extends in a front-and-back direction. On the flat conductive member C, there is formed a plurality of circuit portions (not illustrated), each of which extend in the front-and-back direction. The plurality of circuit portions is arranged in a width direction (a direction perpendicular to the front-and-back direction).

In the embodiment, the circuit portions are embedded within an electrically insulated layer of the flat conductive member C and extends in the front-and-back direction. The plurality of circuit portions reaches a front end of the flat conductive member C. Moreover, the plurality of circuit portions includes both signal circuit portions and grounding circuit portions. Each signal circuit portion has its front end-side part exposed to a lower surface of the flat conductive member C, and can contact with the signal terminal 20. Each grounding circuit portion has its front end-side part exposed to an upper surface of the flat conductive member C, and can contact with the grounding terminal 30.

In addition, the flat conductive member C has a notch C1 on the both side edges of a front part thereof. In front of the notch C1, there is provided a projecting portion C2. A rear edge of the projecting portion C1 serves as an engaged portion C2A to engage with an engaging portion 56B of a movable member 50 of the connector 1 (see FIG. 5(C)).

In the embodiment, the connector 1 includes a housing 10, a plurality of signal terminals 20 and grounding terminals 30, energizing metal fittings 40, and a movable member 50. The housing 10 has an outer shape of a generally rectangular parallelepiped and is made of an electrically insulating material. The pluralities of signal terminals 20 and grounding terminals 30 are made of metal and are arranged in the housing 10, having a longitudinal direction of the housing 10 as an arrangement direction of terminals 20 and 30.

In the embodiment, the energizing metal fittings 40 are held by the housing outside the both ends of the arrangement range of the terminals 20 and 30. The movable member 50 is made of an electrically insulating material and is supported by the housing 10 so as to be switchable (rotatable) between a close position and an open position, which will be described later. To the connector 1, the flat conductive member C is to be inserted and connected from the rear side (a lower left side in FIG. 1).

Before describing a detailed configuration of the connector 1, an operation of inserting and pulling out the flat conductive member C to/from the connector 1 will be briefly described.

Before the flat conductive member C is inserted into the connector 1, the movable member 50 of the connector 1 allows the flat conductive member C to enter at a close position shown in FIG. 1.

In addition, even after inserting and connecting the flat conductive member C to the connector 1, when the connector 1 is in use, the movable member 50 is kept at the close position. As will be described later, the engaging portions 56B of the movable member 50 and the engaged portions C2A of the flat conductive member C are positioned so to be able to engage with each other. As a result, the flat conductive member C is prevented from being pulled out backward (see FIG. 5(C)).

Figure 6:
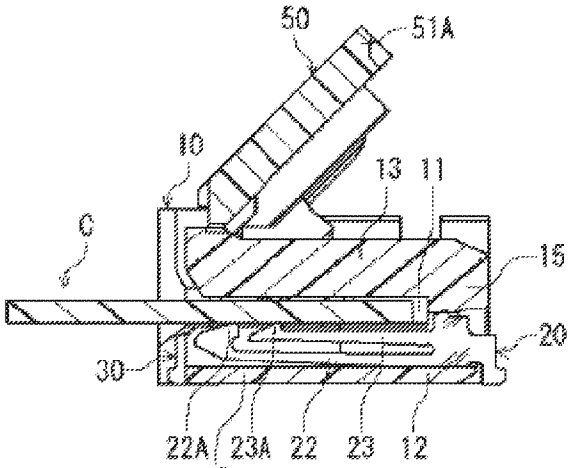
FIGS. 6(A) through 6(D) are sectional views showing the electrical connector for a flat conductive member upon starting to pull out the flat conductive member taken along the surface perpendicular to the arrangement direction of the terminals of the electrical connector according to the embodiment of the present invention.
Figure 6:
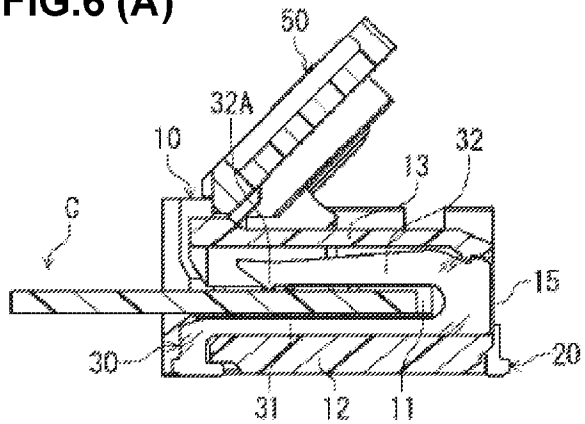
Figure 6:
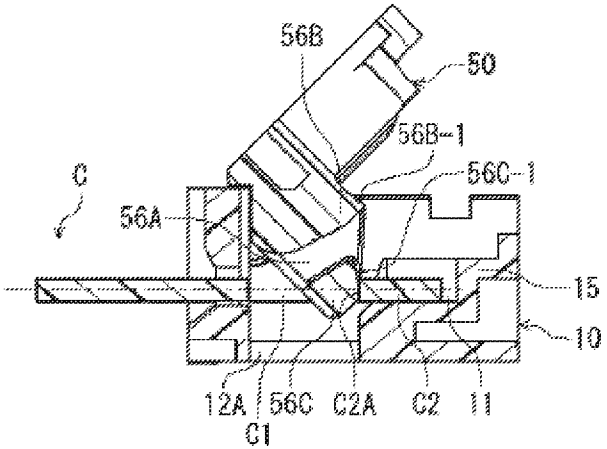
Figure 6:
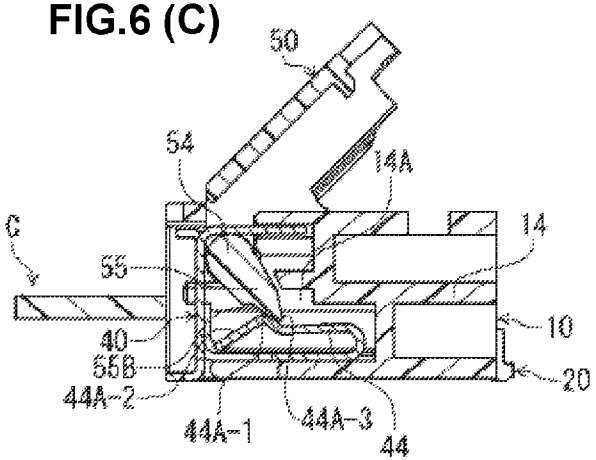
Figure 7:
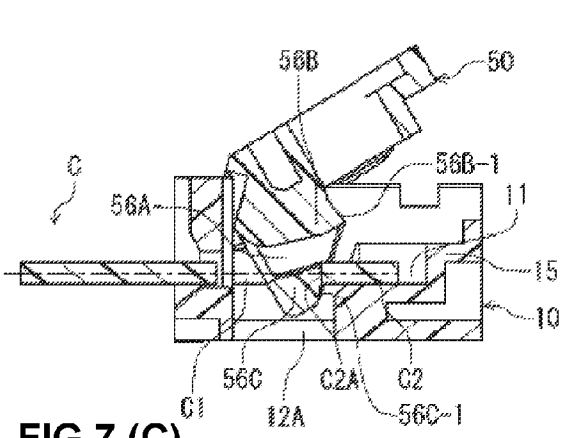
FIGS. 7(A) through 7(D) are sectional views showing the electrical connector for a flat conductive member in the process of pulling out the flat conductive member taken along the surface perpendicular to the arrangement direction of the terminals of the electrical connector according to the embodiment of the present invention.
Figure 7:
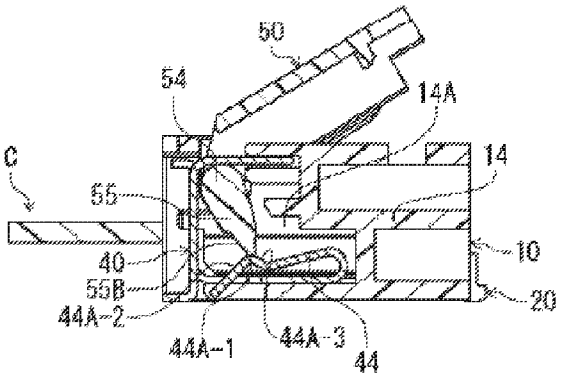
Figure 7:
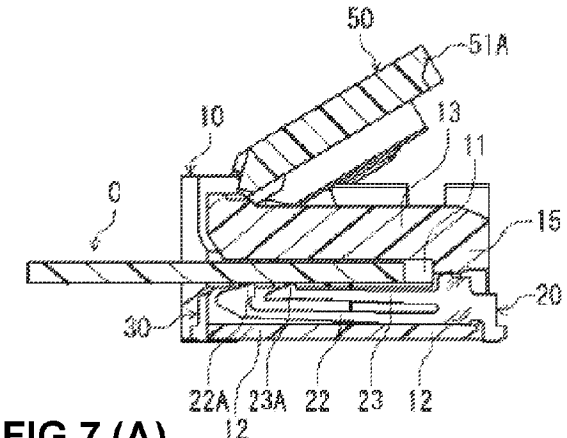
Figure 7:
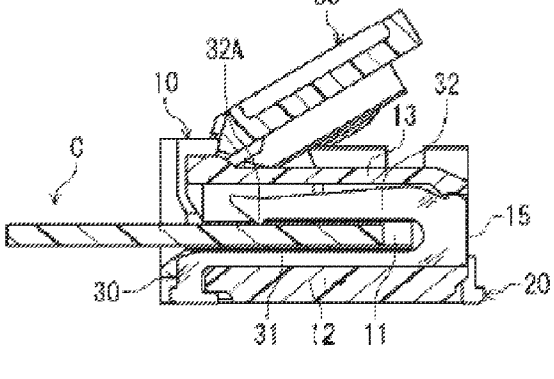

In addition, upon pulling out the flat conductive member C when the connector 1 is not in use, the movable member 50 rotates to switch to the open position, so that the engaged state of the engaging portions 56B of the movable member 50 to the engaged portions C2A of the flat conductive member C is released (see FIG. 6(C)).

Then, once the flat conductive member C is pulled backward, the movable member 50 receives the abutting force from the engaged portions C2A of the flat conductive member C at pressure receiving portions 56C, which will be described later. As a result, the movable member 50 rotates to the close position. In this rotating process, once through grooves 56A of the movable member 50 come into the path of the engaged portions C2A, the flat conductive member C can be pulled out backward.

Even after pulling out the flat conductive member C, the movable member 50 continues to rotate and is automatically brought to the close position. As described above, the pulling out of the flat conductive member C and the rotation of the movable member 50 to the close position are done as a series of operations.

Hereunder, the configuration of the connector 1 will be further described. As shown in FIGS. 1 and 2, the housing 10 extends having one direction horizontal to a mounting surface of the circuit board (not illustrated) as a longitudinal direction. The housing 10 has a receiving section 11 to receive the flat conductive member C as a space opened backward.

In the embodiment, the housing 10 includes a bottom wall 12, an upper wall 13, side walls 14, and a front wall 15 (see FIGS. 3(A) and 3(B)). The bottom wall 12 extends horizontally, while facing the mounting surface. The upper wall 13 faces the bottom wall 12 and extends over the range including an arrangement range of terminals in the longitudinal direction, i.e., the terminal arrangement direction. The side walls 14 are provided on the both ends of the bottom wall 12 and the upper wall 13 in the terminal arrangement direction. The front wall 15 extend over the range including the terminal arrangement range in the terminal arrangement direction and join front ends of the bottom wall 12 and the upper wall 13.

As shown in FIGS. 1 and 2, the above-described receiving portion 11 is surrounded by the bottom wall 12, the upper wall 13, and the two side walls 14, and has an opening that is open backward. The receiving portion 11 receives a front part of the flat conductive member C in a space, which extends from the opening to a rear surface of the front wall 15 in the front-and-back direction (see FIGS. 5(A) and 5(B)).

As shown in FIGS. 1 and 2, in the housing 10, there are provided accommodating portions for signal terminals 17 and accommodating portions for grounding terminals 18. The accommodating portions for signal terminals 17 accommodate and hold the plurality of signal terminals 20. The accommodating portions for grounding terminals 18 accommodate and hold the plurality of grounding terminals 30. The accommodating portions 17 and 18 are respectively formed and arranged at certain intervals in the terminal arrangement direction.

As well shown in FIG. 2, the plurality of accommodating portions for signal terminals 17 is arranged at equal intervals. The accommodating portions for grounding terminals 18 are formed to be between the accommodating portions for signal terminals 17 in the arrangement range of the accommodating portions for signal terminals 17.

As shown in FIG. 3(A), the accommodating portions for signal terminals 17 are formed like slits provided perpendicular to the arrangement direction of the terminals. The accommodating portion for a signal terminal 17 has a front groove 17A, and a lower groove 17B.

In the embodiment, the front groove 17A is provided for pressing to hold therein a portion to be held 21 of the signal terminal 20, which will be described later. The lower grove accommodates a lower arm 22 and an upper arm 23 of the signal terminal 20, which will be described later. The front grooves are formed to penetrate a lower part of the front wall 15. The lower grooves 17B are formed to be dented from an upper surface of the bottom wall 12 and extend backward from the front grooves 17A.

As shown in FIG. 3(B), the accommodating portions for grounding terminals 18 are formed like slits that are provided being perpendicular to the terminal arrangement direction. The accommodating portion for a grounding terminal 18 has a lower groove 18A, an upper groove 18B, a front groove 18C, and a rear groove 18D for accommodating a lower arm 31, an upper arm 32, a joining portion 33, and a portion to be held 34, respectively.

In the embodiment, the lower groves 18A are formed to be dented from an upper surface of the bottom wall 12 and extend in the front-and-back direction. The upper grooves 18B are formed to be dented from a lower surface of the upper wall 13 and extend in the front-and-back direction. The front grooves 18C are formed to penetrate in the front-and-back direction and extend in the up-and-down direction. Moreover, the rear grooves 18D are formed such that a rear end of the bottom wall 12 is dented forward, so as to penetrate in the up-and-down direction and are open backward.

As shown in FIG. 3(C), the bottom wall 12 has a lower accommodating portion 12A outside the ends of the terminal arrangement range in the terminal arrangement direction. The lower accommodating portion 12A receives to accommodate the pressure receiving portion 56C of the movable member 50 that is situated at the close position. The lower accommodating portion 12A is formed to penetrate in the up-and-down direction over the range near a rear end of the terminal arrangement range.

Furthermore, as shown in FIG. 3(C), the upper wall 13 has spaces outside the both ends of the terminal arrangement range in the terminal arrangement direction. The spaces are made by cutting off almost the whole range in the front-and-back direction, corresponding to positions of the lower accommodating portion 12A. Those spaces are made as upper accommodating portions 13A to receive and accommodate the movable member 50 at the close position.

In the embodiment, the upper accommodating portion 13A is formed above the receiving portion 11. The lower accommodating portion 12A is formed below the receiving portion 11. The upper accommodating portion 13A, the receiving portion 11, and the lower accommodating portion 12A are connected to each other.

As well shown in FIGS. 2 and 3(D), the side wall 14 has a side accommodating portion 14A at a rear half part. The side accommodating portion 14A accommodates a rotational shaft 54 and an urged portion 55 of the movable member 50, and also accommodates the energizing metal fitting 40.

As shown in FIG. 3(D), the side accommodating portion 14A is open backward generally over the whole area of the side wall 14 in the up-and-down direction (the range excluding the upper end). With the opened area, it is possible to attach the energizing metal fitting 40 from the back side. In addition, as shown in FIG. 3(D), in the side accommodating portion 14A, a rear part thereof is open upward, so as to receive the rotational shafts 54 of the movable member 50 and a part to be energized 55.

Furthermore, as shown in FIG. 3(D), rear parts of the side accommodating portions 14A are also open downward so as to allow downward elastic displacement of the energizing tongues 44 of the energizing metal fittings 40, which will be described later (see FIG. 4(D)).

In addition, as well shown in FIG. 3(D), the side accommodating portion 14A accommodates and holds the energizing metal fitting 40 in a space formed by a vertical part that extend at a rear side in the up-and-down direction, upper lateral parts, which extend forward from an upper end of the vertical part, and lower lateral parts that extend forward from a lower end of the vertical part. In addition, the space formed between the upper lateral parts and the lower lateral parts allows rotation of the rotational shaft 54 and an urged portion 55 of the movable member 50, which will be described later.

On the facing inner walls that face each other in the terminal arrangement direction and form the side accommodating portion 14A, there is formed a rotational support 14B having a concaved surface. The rotational supports 14B support the rotational shafts 54 of the movable member 50 so as to be rotatable. The concaved surfaces of the rotational supports 14B serve as surfaces that support the rotation.

As well shown in FIG. 2, the signal terminal 20 is made by die-cutting a sheet metal member, while keeping a flat sheet surface thereof. The signal terminals 20 are respectively accommodated in the accommodating portions 17 of the housing 10. As a result, the signal terminals 20 are arranged and held in the housing with the sheet surfaces of all the signal terminals 20 being perpendicular to the terminal arrangement direction.

As shown in FIG. 3(A), the signal terminals 20 has a portion to be held 21, a lower arm 22 and an upper arm 23, and a leg 24. The portions to be held 21 are to be pressed in and held by the front groove 17A of the housing 10. The lower arm 22 and the upper arm 23 extend backward within the lower groove 17B from a rear edge of the portion to be held 21. The leg 24 extends forward from a front edge of the portion to be held 21, then extends downward, and extends outside the housing 10.

In the embodiment, the portion to be held 21 has a press-in protrusion 21A, which protrudes upward from an upper edge thereof. The press-in protrusion 21A is to be pressed in the front groove 17A of the front wall 15 and engages with an upper inner wall surface of the front groove 17A.

In the embodiment, the lower arms 22 and the upper arms 23 can elastically deform in the up-and-down direction. The lower arms 22 and the upper arms 23 contact with a signal circuit portion (not shown), which is exposed to a lower surface of the flat conductive member C, at a rear end with certain contact pressure (see FIG. 5(A)).

In the embodiment, the lower arm 22 extends from a rear edge of the portion to be held 21 to a position of a rear end of the lower groove 17B. As shown in FIG. 3(A), the lower arm 22 extends backward from the rear edge of the portion to be held 21, while contacting with a bottom surface of the lower groove 17B, and then extends to slightly tilt upward as it goes backward. At the rear end of the lower arm 22, there is formed a rear contact portion 22A. The rear contact portion 22A is to contact with the signal circuit portion of the flat conductive member C, and is formed to protrude upward. In a free state of the lower arm 22, the rear contact portion 22A protrudes outside the lower groove 17B to be within the receiving portion 11.

In the embodiment, the upper arm 23 is provided above the lower arm 22. In the middle of the portion to be held 21 in the up-and-down direction, the upper arm 23 extends from a rear edge of the portion to be held 21 to a position close to the rear end of the lower groove 17B. In other words, the upper arm 23 extends to a position in front of the rear end of the lower arm 22 so as to slightly tilt upward as it goes backward.

At the rear end of the upper arm 23, there is formed a front contact portion 23A. The front contact portion 23A is to contact with the signal circuit portion of the flat conductive member C, and is formed to protrude upward. In a free state of the upper arm 23, the front contact portion 23A protrudes outside the lower groove 17B in front of the rear contact portion 22A of the lower arm 22. The front contact portion 23A is substantially at the same height level as that of the rear contact portion 22A in the receiving portion 11.

A lower end of the leg 24 is formed as a connecting portion 24A to connect to a circuit board (not shown). The connecting portion 24A has a lower edge, which is situated at substantially the same height level as that of a lower surface of the bottom wall 12 of the housing 10. The lower edge of the connecting portion 24A is to be connected with solder to a corresponding signal circuit portion of the circuit board (not shown).

In the embodiment, the signal terminals 20 having the above-described configuration are to be attached to the housing 10, being pressed from the front side into the accommodating portions for signal terminals 17 in the housing 10. Upon attaching the signal terminals 20, the portions to be held 21 are pressed into the front grooves 17A.

In the embodiment, the press-in protrusion 21A of the portion to be held 21 engages with an upper inner wall of the front groove 17A. In addition, the lower edge of the portion to be held 21 abuts against the groove bottom of the front groove 17A and the lower edge of the lower arm 21 abuts against the grooves' bottom (lower inner wall surface) of the lower groove 17B, with certain contact pressure. As a result, the signal terminals 20 are held in the accommodating portions for signal terminals 17.

Similarly to the signal terminals 20 described above, the grounding terminals 30 are made by die-cutting of sheet metal members, while keeping their sheet surfaces. Being respectively accommodated in the accommodating portions for grounding terminals 18 in the housing 10, the grounding terminals 30 are arranged and held in the housing 10, with sheet surfaces of all the grounding terminals 30 being perpendicular to the terminal arrangement direction.

As shown in FIG. 3(B), the grounding terminal 30 includes a lower arm 31, an upper arm 32, a joining portion 33, and a portion to be held 34. The lower arms 31 extend in the front-and-back direction within the lower groove 18A of the accommodating portion for grounding terminals 18. The lower arms 31 extend in the up-and-down direction within the front groove 18C. The joining portion 33 joins between front ends of the lower arm 31 and the upper arm 32. The portion to be held 34 extends downward from a rear end of the lower arm 31 within the rear groove 18D.

In the embodiment, the lower arm 31 extends straight along the groove bottom of the lower groove 18A in the front-and-back direction substantially over the whole area of the lower grooves 18A. The upper arm 32 extends from the rear end of an upper part of the joining portion 33 to a middle position between the rear contact portion 22A and the front contact portion 23A of the signal terminal 20, so as to tilt downward as it goes backward.

At a rear end of the upper arm 32, there is formed a grounding contact portion 32A so as to protrude downward. The grounding contact portion 32A is to contact with a grounding circuit portion (not shown) provided on an upper surface of the flat conductive member C. In a free state of the upper arm 32, the grounding contact portion 32A protrudes outside the upper groove 18B to be within the receiving portion 11.

In the embodiment, the joining portion 33 has a press-in protrusion 33A, which protrudes upward from an upper edge of the joining portion 33. Being pressed in the front groove 18C of the front wall 15, the press-in protrusion 33A engages with the upper inner wall surface of the front groove 18C. Moreover, the portion to be held 34 has a press-in concave portion 34A, which is dented from the front edge. Into the press-in concave portion 34A, the rear end of the bottom wall 12 is to be pressed.

In the embodiment, the portion to be held 34 has a lower end, which is formed as a connecting portion 34B to connect to the circuit board (not shown). The lower end of the connecting portion 34B is substantially the same height level as a lower surface of the bottom wall 12 of the housing 10, so as to be connected to corresponding grounding circuit portion of the connecting portion (not shown) by soldering.

In the embodiment, the grounding terminals 30 having the above-described configuration are attached in the housing 10, being pressed from the back side into the accommodating portions for grounding terminals 18 of the housing 10. Upon attaching the grounding terminals 30, the joining portions 33 are pressed in the front grooves 18C. The press-in protrusions 33A of the joining portions 33 engage with the upper inner wall surfaces of the front grooves 18C.

At the same time, the lower edges of the joining portions 33 abut against the groove bottom of the front grooves 18C and the lower edges of the lower arms 31 abut against the bottom (lower inner wall surfaces) of the lower grooves 18A, with a certain contact pressure. In addition, the rear end of the bottom wall 12 is pressed in the press-in concave portions 34A of the portions to be held 34. As a result, the grounding terminals 30 are held in the accommodating portions for grounding terminals 18.

As shown in FIGS. 2 and 3(D), the energizing metal fitting 40 is made by bending a generally strip-like sheet metal member in the sheet thickness direction at a middle position in the longitudinal direction of the sheet metal member. Hereunder, for the energizing metal fittings 40, a lateral direction of the sheet metal member, i.e., a direction identical to the terminal arrangement direction, is referred to as "width direction".

In the embodiment, the energizing metal fitting 40 includes a lower flat portion 41, a rear flat portion 42, an upper flat portion 43, an energizing tongue 44, and a securing portion 45. The lower flat portion 41 faces the mounting surface of the circuit board. The rear flat portion 42 is bent at a rear end of the lower flat portion 41 to extend upward. The energizing tongue 44 has flexibility, and is formed being folded back at a front end of the lower flat portion 41 and then extends backward to be above the lower flat portion 41. The securing portion 45 is formed being bent at a lower end of the rear flat portion 42 to extend backward.

As shown in FIG. 3(D), the lower flat portion 41 of the energizing metal fitting 40 extends in the front-and-back direction along a lower wall 14A-1 of the side accommodating portion 14A. When the energizing metal fittings 40 are attached to the housing 10 from the back side, the lower flat portions 41 contact by pressure to the facing inner wall surfaces (a pair of inner walls that face each other in the terminal arrangement direction) of the side accommodating portions 14A at the side edges of the lower flat portion 41.

As a result, the lower flat portions 41 are pressed and held therein. In addition, at the rear part of the lower flat portion 41, there is formed a notch 41A in the middle part in the terminal arrangement direction. The notches 41A allow free ends of the energizing portions 44 to elastically displace downward (see FIG. 4(D)).

As shown in FIG. 2, the rear flat portion 42 is formed to bend at both ends of the rear end of the lower flat portion 41 in the width direction, and extends upward.

As shown in FIG. 2, the upper flat portion 43 is formed by bending a middle portion of the upper part of the rear flat portion 42 in the width direction to extend forward. As shown in FIG. 3(D), the upper flat portion 43 extends in the front-and-back direction along the upper wall 14A-2 of the side accommodating portion 14A. In addition, when the energizing metal fittings 40 are attached to the housing 10 from the back side, the upper flat portions 43 are pressed and held therein, being pressed to contact to the facing inner wall surfaces (a pair of inner wall surfaces that face each other in the terminal arrangement direction) of the side accommodating portions 14A at the side edges of the upper flat portions 43.

As well shown in FIG. 3(D), the energizing tongue 44 has a cantilever-like shape, which extends backward to be close to the rear end of the lower flat portion 41. The energizing tongues 44 can elastically displace in their sheet thickness direction (in the up-and-down direction in FIG. 3(D)). At the rear end-side part of the energizing tongue 44, there is formed an energizing portion 44A to energize the urged portion 55 of the movable member 50. The energizing portion 44A is bent to have a bent portion 44A-1, which has a dogleg-like shape as a whole, protruding upward at the middle position in the front-and-back direction.

In the embodiment, the energizing portion 44A has a first energizing surface 44A-2. The first energizing surface 44A-2 is formed on an upper surface of a part behind the bent portion 44A-1, i.e., a part tilting downward as it goes backward. The first energizing surface 44A-2 is for energizing a first surface to be energized 55A of the movable member 50 to the close position.

In addition, the energizing portion 44A has a second energizing surface 44A-3. The second energizing surface 44A-3 is formed on an upper surface of a part in front of the bent portion 44A-1, i.e., a part tilting upward as it goes backward. The second energizing surface 44A-3 is for energizing a second surface to be energized 55B of the movable member 50 to the open position.

As shown in FIG. 2, the securing portion 45 is formed to bend at a middle part in the width direction of the rear flat portion 42, and extends backward from a lower end of the rear flat portion 42. As shown in FIG. 3(D), a lower surface of the securing portion 45 is situated at substantially the same height level as that of a lower surface of the bottom wall 12 of the housing 10. The lower surface of the securing portion 45 is to be secured onto the circuit board, being soldered to connect to corresponding portion of the circuit board (not shown).

Next, referring to FIG. 2, which mainly shows the movable member 50 is situated at the close position, the configuration of the movable member 50 will be described. As for a rotational direction of the movable member 50, for convenience of explanation, a direction from the open position to the close position (clockwise direction in FIGS. 3(C) and 3(D)) is referred to as "closing direction", and a direction from the close position to the opening direction (counterclockwise direction in FIGS. 3(C) and 3(D)) is referred to as "opening direction".

As shown in FIG. 2, the movable member 50 includes a main body 51, end flat portions 52, joining portions 53, rotational shafts 54, portions to be energized 55, and extending portions 56. The main body 51 has a flat shape and extends having the terminal arrangement direction as its longitudinal direction. The end flat portions 52 are provided both ends of the main body 51 in the terminal arrangement direction.

According to the embodiment, when the movable member 50 is situated at the close position (see FIGS. 3(A) through 3(D)), the movable member 50 interferes with the upper wall 13 of the housing 10 and is prevented from rotation in the closing direction.

In the embodiment, the main body 51 is subject to the rotational operation of the movable member 50 between the close position and the open position. The main body 51 is formed as a release operating portion 51A, which is subject to an operation that a front end of the main body 51 (a right end in FIG. 3(A)) at the close position rotates the movable member 50 from the close position to the open position.

As shown in FIG. 3(A), because of presence of space formed with an upper surface of the housing 10, hooking the release operating portion 51A with a finger to rotate the movable member 50 in the opening direction, it is achievable to release the engaged state between an engaging portion 56B, which will be described later, and an engaged portion C2A of the flat conductive member C.

As shown in FIG. 2, the end flat portions 52 are provided at the both ends of the main body 51 in the terminal arrangement direction, having their sheet surfaces be perpendicular to the terminal arrangement direction. Rear ends of the end flat portions 52 extend backward further than a rear end of the main body 51. The joining portions 53 extend backward from a rear end of the main body 51, having their sheet surfaces be perpendicular to the terminal arrangement direction at a position inner than the end flat portion 52 in the terminal arrangement direction. The joining portion 53 faces a rear end portion of the end flat portion 52.

In the embodiment, the rotational shaft 54 extends in the terminal arrangement direction so as to join opposing plate surfaces of a rear end of the end flat portion 52 and the joining portion 53, which face each other, at a position that corresponds to the side accommodating portion 14 of the housing 10. Accordingly, the rotational shaft 54 is joined to the main body 51 with the rear end of the end flat portion 52 and the joining portion 53.

In the embodiment, the rotational shaft 54 has a convex surface on a circumferential surface around the axis. The convex surfaces at the both ends of the rotational shaft 54 in the terminal arrangement direction are supported by the rotational supports 14B, which are provided on the side walls 14 of the housing 10, so as to be rotatable (see FIG. 3(D)). In addition, in FIGS. 3(C) and 3(D), a rotational center 54A of the rotational shaft 54 is indicated with a cross mark.

In the embodiment, the urged portion 55 engages with the engaging tongue 44 of the energizing metal fitting 40, and receives urged force from the energizing tongue 44 towards the close position or towards the open position. As shown in FIG. 2, the urged portion 55 extends downward from a center part of the rotational shaft 54 in the terminal arrangement direction.

As shown in FIG. 3(D), in the urged portion 55, the front surface (right surface in FIG. 3(D)) and a rear surface (left surface in FIG. 3(D)) of a lower portion has a slanted surface so as to be close each other as it goes downward. The urged portion 55 has a tapered shape, which is narrower at the lower part when viewed in the terminal arrangement direction.

Figure 4:
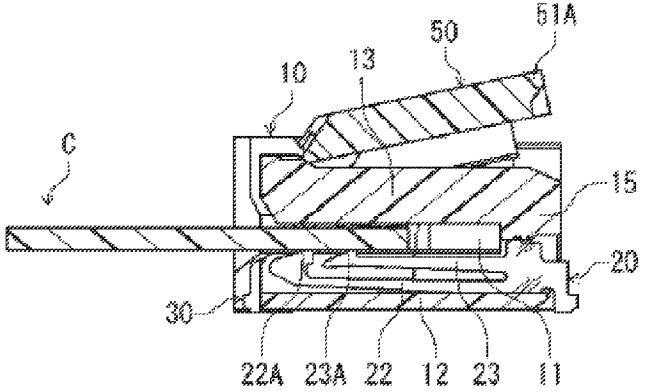
FIGS. 4(A) through 4(D) are sectional views showing the electrical connector for a flat conductive member in the process of inserting the flat conductive member into the electrical connector taken along the surface perpendicular to the arrangement direction of the terminals of the electrical connector according to the embodiment of the present invention.
Figure 4:
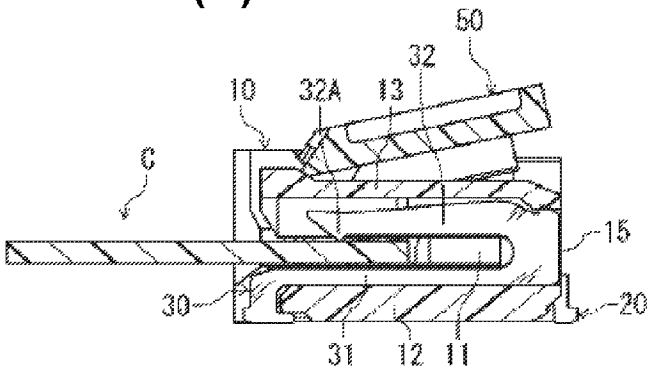
Figure 4:
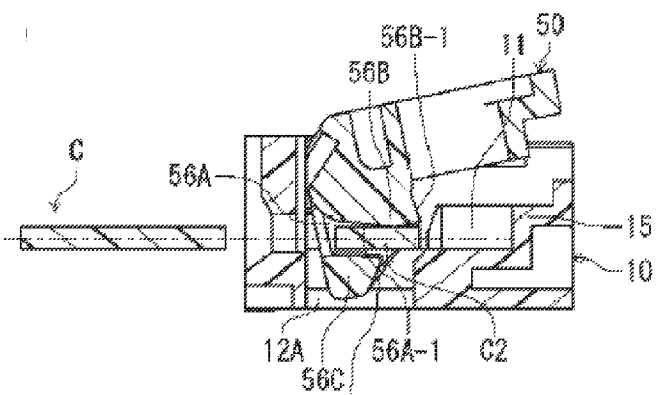
Figure 4:
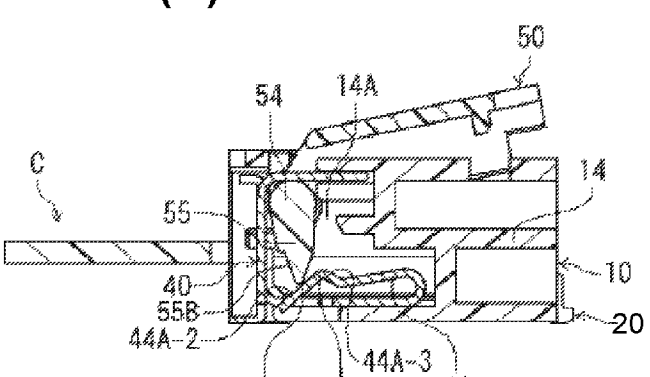
Figure 5:
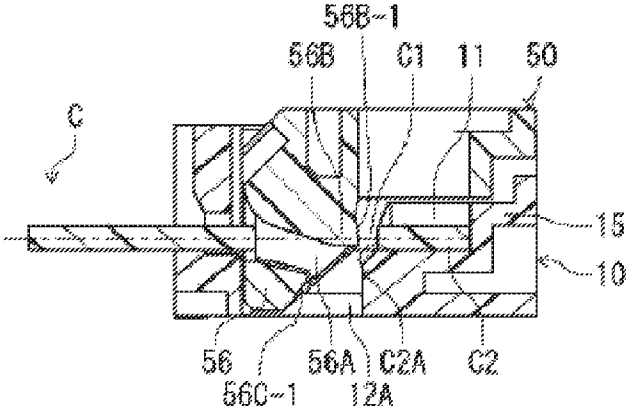
FIGS. 5(A) through 5(D) are sectional views showing the electrical connector for a flat conductive member upon completion of inserting the flat conductive member taken along the surface perpendicular to the arrangement direction of the terminals of the electrical connector according to the embodiment of the present invention.
Figure 5:
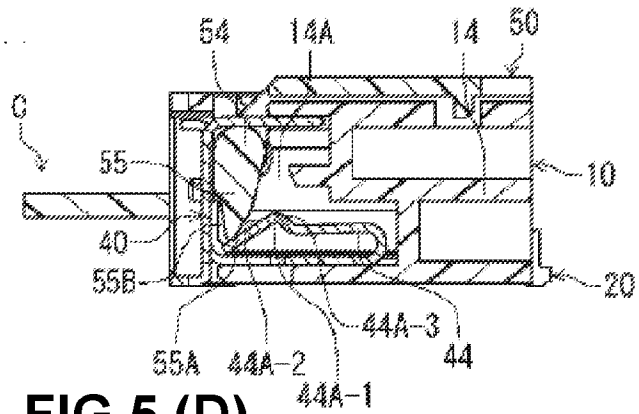
Figure 5:
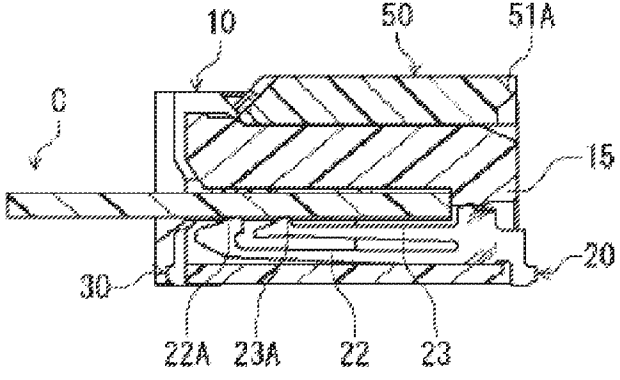
Figure 5:
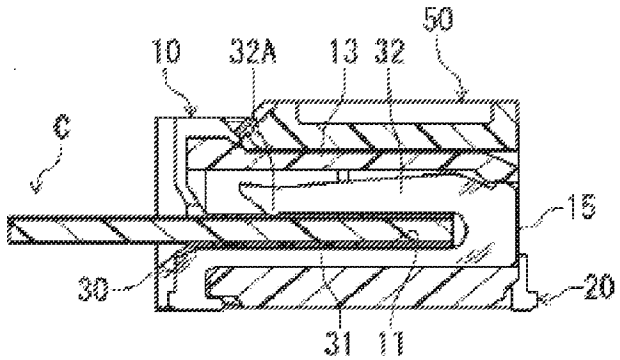

As shown in FIG. 3(D), a lower end surface of the urged portion 55 is formed as a first surface to be energized 55A, which receives urged force from the first energizing surface of the energizing tongue 44 of the energizing metal fitting 40 towards the close position (see also FIGS. 4(D) and 5(D)). In addition, a rear surface of the lower part of the urged portion 55 is formed as a second surface to be energized 55B, which receives urged force from the second energizing surface 44A-3 of the energizing tongue 44 of the energizing metal fitting 40 towards the close position (see FIG. 6(D)).

As shown in FIGS. 2 and 3(C), the extending portion 56 is formed at an inner position adjacent to the joining portion 53 in the terminal arrangement direction, so as to extend downward from the rear part of the main body 51 of the movable member 50. In the extending portion 56, when viewed in the terminal arrangement direction, a position close to the rear end of the upper part of the extending portion 56 is aligned to the position of the rotational center 54A of the rotational shaft 54.

In the embodiment, the extending portion 56 has a through groove 56A. The through groove 56A extends in the front-and-back direction at a middle part in the up-and-down direction and penetrates. The through groove 56A is formed being dented from an inner side surface of the extending portion 56 in the terminal arrangement direction. As will be described later, the through groove 56A forms passage-allowing space that allows the engaged portion C2A of the flat conductive member C to pass through, when the movable member 50 is brought to a certain angular position.

As shown in FIG. 3(C), the through groove 56A is formed as a groove, which is slightly slanted downward as it goes forward, when the movable member 50 is situated at the close position. An upper inner wall surface 56A-1 of the through groove 56A is slanted so as to be close to the lower inner wall surface of the receiving portion 11 as it goes frontward.

In the embodiment, the distance between a front half part of the upper inner wall surface 56A-1 and the lower inner wall surface 11A in the up-and-down direction is set smaller than the thickness than that of the flat conductive member C. Therefore, in the process of inserting the flat conductive member C, the projecting portion C2 of the flat conductive member C that entered the through groove 56A is to rotate the movable member 50 to the opening direction (see FIG. 4(C)).

Moreover, a part located right above the through groove 56A of the extending portion 56 is formed as an engaging portion 56B, which can engage with the engaged portion C2A of the flat conductive member C that receives backward pull-out force when the movable member 50 is situated at the close position.

As shown in FIG. 3(C), the engaging portion 56A is located below the rotational shaft 54 when the movable member 50 is situated at the close position. When the engaging portion 56B receives backward pull-out force from the engaged portion C2A, moment will be generated so as to rotate the movable member 50 to the closing direction around the rotational center 54A of the rotational shaft 54.

As shown in FIG. 3(C), a front surface of the engaging portion 56B, i.e., an engaging surface 56B-1 that can engage with the engaged portion C2A is formed as a slanted surface that slants forward as it goes downward, when the movable member 50 is situated at the close position. A distance between the front half part of the upper inner wall surface 56A-1 and the lower inner wall surface 11A in the up-and-down direction is smaller than the thickness of the flat conductive member C.

In the embodiment, while the engaged portion C2A engages with the engaging surface 56B-1, an angle between the engaging surface 56B-1 of the engaging portion 56B and the pull-out direction of the flat conductive member C becomes an acute angle on the rear side of the engaging surface 56B-1 and the side opposite to the through groove 56A relative to the passing path (represented with a projected line in FIG. 5(C)) of the engaged portion C2A.

In addition, a part below the through groove 56A of the extending portion 56 is formed as a pressure receiving portion 56C. The pressure receiving portion 56C can abut against the engaged portion C2A of the flat conductive member C, which receives the backward pull-out force, when the movable member 50 is situated at the open position. Regardless of the angular position of the movable member 50, the pressure receiving portion 56C is always below the rotational shaft 54. When the pressure receiving portion 56C receives an abutting force from the engaged portion C2A, moment will be generated to rotate the movable member 50 to the closing direction around the rotational center 54A of the rotational shaft 54.

A front surface of the pressure receiving portion 56C, i.e., the pressure receiving surface that can abut against the engaged portion C2A, is formed as a slanted surface. The slanted surface is slanted forward as it goes upward as shown in FIG. 3(C) when the movable member 50 is situated at the close position.

In the embodiment, as shown in FIG. 6(C), when the movable member 50 is situated at the open position, while the engaged portion C2A engages with the engaging surface 56C-1, an angle between the pressure receiving surface 56C-1 of the pressure receiving portion 56C and the pull-out direction of the flat conductive member C becomes a blunt angle on the rear side of the pressure receiving surface 56C-1 and the side opposite to the through groove 56A relative to the passing path (represented with a projected line in FIG. 6(C)) of the engaged portion C2C.

In the embodiment, the connector 1 having the above-described configuration will be assembled as follows. First, the signal terminals 20 are pressed in to attach to the accommodating portions for signal terminals 17 of the housing 10 from the front side. In addition, the grounding terminals 30 are pressed in to attach to the accommodating portions 18 for grounding terminals 18 of the housing 10 from the back side. Moreover, accommodating the rotational shaft 54 of the movable member 50 inside the side accommodating portion 14A of the housing 10 from above, so as to attach the movable member 50 to the housing 10.

As a result, the rotational shaft 54 is supported by the rotational support 14B so as to be rotatable (see FIG. 3(D)). Furthermore, the upper part of the extending portion 56 is accommodated inside the upper accommodating portion 13A of the housing 10. The engaging portion 56B of the extending portion 56 is accommodated inside the receiving portion 11 of the housing 10. The pressure receiving portion 56C is accommodated in the lower accommodating portion 12A of the housing 10 (see FIG. 3(C)). The above-described steps of attaching the signal terminals 20, of attaching the grounding terminals 30, and of attaching the movable member 50 may be performed in any order or at the same time.

Next, respectively pressing the lower flat portion 41 and the upper flat portion 43 of the energizing metal fitting 40 in the side accommodating portion 14A of the housing 10 from the back side, the energizing metal fitting 40 is attached to the housing 10. As a result of attaching the energizing metal fitting 40 to the housing 10, the upper flat portion 43 of the energizing metal fitting 40 is located between the end flat portions 52 of the movable member 50 and the joining member 53 in the terminal arrangement direction and located right under the upper wall 14A-2 in the up-and-down direction. Moreover, the upper flat portion 43 is located above the rotational shaft 54. With the upper flat portion 43, the movable member 50 is prevented from unexpectedly coming off from the housing 10 (see FIG. 3(D)).

Next, the operation of connecting the connector 1 to the flat conductive member C will be described based on FIGS. 3(A)-3(D) through 5(A)-5(D).

First, the connecting portions 24A of the signal terminals 20 and the connecting portions 34B of the grounding terminals 30 in the connector 1 are connected by soldering to corresponding circuit portions of the circuit board. In addition, the securing portion 45 of the energizing metal fitting 40 is secured by soldering to connect to corresponding part of the circuit board.

Next, as shown in FIGS. 3(A) through 3(D), the flat conductive member C is placed behind the connector 1, so as to extend in the front-and-back direction along the mounting surface of the circuit board (not illustrated). After that, the flat conductive member C is inserted forward to the receiving portion 11 of the connector 1.

In the process of inserting the flat conductive member C to the receiving portion 11, the flat conductive member C moves forward so as to widen between the grounding contact portions 32A of the upper arms 32 of the grounding terminals 30 and the rear contact portions 22A of the lower arms 22 of the signal terminals 20, and between the he grounding contact portions 32A of the upper arms 32 of the grounding terminals 30 and the front contact portions 23A of the upper arms 23. As a result, as shown in FIGS. 4(A) and 4(B), the upper arms 32 of the grounding terminals 30 elastically displace upward. The lower arms 22 and the upper arms 23 of the signal terminals 20 elastically displace downward.

According to the embodiment, in the process of inserting the flat conductive member C, counterforce from the lower arms 22 and the upper arms 23 of the signal terminals 20 works on the flat conductive member C from below. As a result, the upper arms 32 of the grounding terminals 30 receive the counterforce via the flat conductive member C. As described above, receiving the counterforce by the upper arms 32 of the grounding terminals 30, it is achievable to prevent deformation and damage of the upper wall 13 of the housing 10.

In addition, after the projecting portion, which is provided close to the both ends of the flat conductive member C, enter the through groove 56A of the movable member 50, the front edge of the projecting portion C2 abuts against the upper inner wall surface 56A-1 of the through groove 56A. With this abutting force, the movable member 50 rotates in the opening direction.

As a result, as shown in FIG. 4(C), the projecting portion C2 supports the upper inner wall surface 56A-1 from below. The rotational angle of the movable member 50 is maximum in the process of inserting the flat conductive member C. Furthermore, at this point, the through groove 56A is located on the passing path (indicated with a dash-and-dotted line) all over the range in the pull-out direction of the flat conductive member C. Accordingly, the projecting portion C2, and in turn the flat conductive member C, is allowed to further enter forward.

With the above-described rotation of the movable member 50, the urged portion 55 of the movable member 50 is also rotated in the opening direction. As shown in FIG. 4(D), the urged portion 55 presses the first energizing surface 44A-2 of the energizing metal fitting 40 with its lower end, and elastically displace the energizing tongue 44 downward.

As a result, by the resilience of the energizing tongue 44, the first energizing surface 44A-2 energizes a lower end surface of the urged portion 55, i.e., the first surface to be energized 55A, in the opening direction. In addition, FIG. 4(D) shows a state where the rotational angle of the movable member 50 is the maximum.

In the embodiment, the lower end of the urged portion 55 will not move beyond the bent portion 44A-1 of the energizing tongue 44. Therefore, in the process of inserting the flat conductive member C, the urged portion 55 will not receive urged force that is directed to the open position.

Once the flat conductive member C is further inserted forward, as shown in FIGS. 5(A) through 5(C), the projecting portion C2 of the flat conductive member C passes by, and is brought to the position where the insertion completes. As shown in FIG. 5(A), in the state where the insertion of the flat conductive member C is completed, the elastically displaced state of the lower arms 22 and the upper arms 23 of the signal terminals 20 is maintained.

In addition, the state is maintained, in which the signal circuit portion (not illustrated) on a lower surface of the flat conductive member C, the rear contact portions 22A, and the front contact portions 23A contact and electrical connect to each other with certain contact pressure.

Moreover, as shown in FIG. 5(B), the elastically displaced state of the upper arms 32 of the grounding terminals 30 is maintained. In addition, the state is maintained, in which the grounding circuit portion (not illustrated) on the upper surface of the flat conductive member C and the grounding contact portions 21A contact and electrically connect to each other with certain contact pressure. As described above, the operation of connecting the flat conductive member C is completed.

Moreover, once the flat conductive member C is brought to the position to complete the insertion, as shown in FIG. 5(C), the projecting portion C2 of the flat conductive member C passes the position of the engaging portion 56B and is brought in front of the engaging portion 56B. As a result, the movable member 50 receives the urged force from the energizing tongue 44 of the energizing metal fitting 40 and returns to the close position.

As shown in FIG. 5(C), the engaging portion 56B enters the notch C1 of the flat conductive member C. Then, the engaged portion C2A of the flat conductive member C comes to a position so as to be able to engage with the engaging surface 56B-1 of the engaging portion 56B. As a result, the flat conductive member C is prevented from being pulled out backward.

Once the movable member 50 is brought back to the close position, as shown in FIG. 5(D), the first energizing surface 44A-2 of the energizing tongue 44 contact by surface and engages with the first engaged surface 55A of the engaged portion 55. Therefore, the movable member 50 is always kept at the close position.

Accordingly, even if the movable member 50 unexpectedly receives external force and is slight lifted in the opening direction, while the connector 1 and the flat conductive member C is in the state of being connected, the movable member 50 is pushed back to the close position by the urged force from the first energizing surface. Therefore, the movable member 50 will not unexpectedly rotate to the open position.

When backward pull-out force is unexpectedly applied on the flat conductive member C, which is in the state of being connected with the connector 1, the engaged portion C2A of the flat conductive member C engages with the engaging surface 56B-1 of the engaging portion 56B of the movable member 50 from the front side.

In the embodiment, the location of the rotational shaft of the movable member 50 relative to the engaging surface 56B is set so as to generate force to rotate the movable member 50 in the closing direction. Therefore, it is achievable to securely maintain the engaged state. In addition, according to the embodiment, the movable member 50 at the close position interferes with the upper wall 13 of the housing 10, and the rotation to the closing direction is prevented. Therefore, even if the engaging surface 56B receives the above-described force from the engaged portion C2A, the movable member 50 will not rotate in the closing direction.

Furthermore, according to the embodiment, as described above, the engaging surface 56B-1 of the engaging portion 56B at the close position is formed as a slanted surface, which is slanted forward as it goes downward. Therefore, on the engaged portion C2A, the force will work upward along the engaging surface 56B-1, i.e., the force will work in a direction to be away from the through groove 56A. In other words, the engaged portion C2A receives force that works towards the direction opposite to the direction of being away from the engaging portion 56B. As a result, the engaged portion C2A will more strongly engage with the engaging portion 56B.

Next, referring to FIGS. 5(A)-5(D) through 7(A)-7(D), the operation of pulling out the flat conductive member C from the connector 1 will be described.

First, as shown in FIGS. 5(A) through 5(D), in the state of being connected to the flat conductive member C, hooking the release operating portion 51A of the movable member 50 of the connector 1 to lift with a finger, rotate the movable member 50 towards the open position shown in FIGS. 6(A) through 6(D) against the urged force towards the close position from the energizing tongue 44 of the energizing metal fitting 40.

At this time, the engaging portion 56B moves upward, i.e., in a direction so as to be away from the notch C1 of the flat conductive member C.

In the process that the movable member 50 rotates to the open position, the lower end of the urged portion 55 of the movable member 50 elastically displace the energizing tongue 44 of the energizing metal fitting 40 downward. Until the time the lower end reach the bent portion 44A-1 of the energizing tongue 44, the first energizing surface 44A-2 of the energizing tongue 44 energizes the movable member 50 towards the close position.

Furthermore, rotating the movable member 50, once the lower end goes beyond the bent portion of the energizing tongue 44 and reach the area of the second energizing surface 44A-3, the energizing tongue moves back to the direction (upward) to reduce the elastic displacement and energizes the urged portion to the open position.

As described above, once the movable member 50 is switched to the open position, as shown in FIG. 6(D), the second energizing surface 44A-3 of the energizing tongue 44 contacts by surface and engages with the second engaged surface 55B of the engaged portion 55. Therefore, even if the movable member 50 receives some external force, the movable member 50 can go back to the open position by the urged force and keeps at the open position.

Furthermore, once the movable member 50 is switched to the open position, as shown in FIG. 6(C), the engaging portion 56B completely come out from the notch C1 of the flat conductive member C. As a result, the state of being engaged with the engaged portion C2A of the flat conductive member C is released.

Then, as shown in FIG. 6(C), the pressure receiving portion 56C of the movable member 50 enters the notch C1 from below. The pressure receiving surface 56C-1 of the pressure receiving portion 56C is located to be able to abut against the engaged portion C2A in the pull-out direction of the flat conductive member C.

Next, once the flat conductive member C is pulled backward, as shown in FIG. 6(C), the engaged portion C2A of the flat conductive member C abuts against the pressure receiving surface 56C-1 of the pressure receiving portion 56C of the movable member 50. At this point, the movable member 50 is situated at the open position. Therefore, being different from when the movable member 50 is situated at the close position, the rotation in the closing direction will not be prohibited by the upper wall 13 of the housing 10. Therefore, with the abutting force received by the pressure receiving surface 56C-1 from the engaged portion C2A, the movable member 50 is rotated toward the close position (refer to FIGS. 7(A) to 7(D)) against the urging force of the energizing tongue 44 of the energizing metal fitting 40 toward the open position caused when the lower edge portion of the urged portion 55 (refer to FIG. 7(D)).

According to the embodiment, as described above, in the state the engaged portion C2A abuts against the pressure receiving surface 56C-1 (see FIG. 6(C)), the angle between the pressure receiving surface 56C-1 and the pull-out direction of the flat conductive member C is obtuse behind the pressure receiving surface 56-1 and the side opposite to the through groove 56A relative to the path (indicated with a dash-and-dotted line in FIG. 6(C)) of the engaged portion 56A.

Therefore, on the engaged portion C2A, the force works, which is upward along the pressure receiving surface 56C-1, i.e., in a direction of going towards the pass allowing space (direction to be away from the bottom surface of the receiving portion 11 and the lower accommodating portion 12A of the housing 10). In other words, even when the movable member 50 rotates in the close position, the engaged portion C2A will not be pulled downward by the pressure receiving portion 56C.

Therefore, by having the engaged portion C2A pass the through groove 56A towards the pull-out direction, it is easy to pull out the flat conductive member C. Moreover, in the process of rotating the movable member 50, it is achievable to prevent the engaged portion from being caught by the gap formed between the pressure receiving portion 56C and the front wall surface of the lower accommodating portion 12A.

Once the movable member 50 rotates towards the close position, in the rotating process, the through groove 56A of the movable member 50 is brought to the position on the passing path of the engaged portion C2AQ over the whole area in the pull-out direction. As a result, the projecting portion C2 is allowed to pass backward. Then, the engaged portion C2A passes backward in the through groove 56A (see FIG. 4(B) for the state the engaged portion C2A passes in the through groove 56A), the flat conductive member C can be pulled out backward without problem, and the operation of pulling out is completed.

In addition, at the time the through groove 56A is brought to a point in the path for the engaged portion to pass, the lower end of the urged portion 55 already went beyond the bent portion 44A-1 of the energizing tongue 44 of the energizing metal fitting 40. The first surface to be energized 55A of the urged portion 55 receives urged force towards the close position from the first energizing surface 44A-2 of the energizing tongue 44.

Accordingly, even after the engaged portion C2A of the flat conductive member C passes the through groove 56A, the movable member 50 continues to rotate and will automatically reach the close position. As described above, the pulling out of the flat conductive member C and the rotation of the movable member 50 to the close position are performed in a short amount of time as a series of movements. Therefore, according to the embodiment, after pulling out the flat conductive member C, the worker does not have to bring the movable member 50 back to the close position from the open position for the next insertion, and thereby it is achievable to improve the work efficiency. Since it is achievable to prevent the movable member 50 of the connector 1 from unexpectedly staying at the open position, the movable member 50 will not be in the way upon connecting other electronic components on a circuit board, on which the connector 1 is mounted.

According to the embodiment, the movable member 50 is energized by the energizing metal fitting, but it is not essentially required to provide the energizing metal fitting. In case of not being able to provide such energizing metal fitting, for example, when the movable member is brought to the open position, the movable member can be kept at the open position by being supported by the housing, terminals, or the like. In addition, when the movable member is situated at the position other than the open position, it is achievable to automatically bring the movable member to the close position by its own weight.

The disclosure of Japanese Patent Applications No. 2015-051142, filed on Mar. 13, 2015, is incorporated in the application by reference.

While the present invention has been explained with reference to the specific embodiments of the present invention, the explanation is illustrative and the present invention is limited only by the appended claims.

What is claimed is:

1. An electrical connector to be connected to a flat conductive member, comprising:

a housing including a receiving portion for receiving the flat conductive member;

a plurality of terminals arranged in the housing in a terminal arrangement direction; and a movable member arranged to be rotatable between an open position and a close position relative to the housing, wherein said movable member includes an engaging portion for engaging an engaged portion formed on the flat conductive member when the movable member is situated at the close portion, said movable member further includes a pressure receiving portion for abutting against the engaged portion when the movable member is situated at the open portion, said movable member further includes a passing allowing space between the engaging portion and the pressure receiving portion for allowing the engaged portion to pass through, and said movable member is configured so that the engaged portion passes through the passing allowing space when the movable member is rotated toward the close position.

2. The electrical connector assembled component according to claim 1, wherein said movable member includes the pressure receiving portion at a specific location so that the movable member is rotated toward the close position when the pressure receiving portion abuts against the engaged portion.

3. The electrical connector assembled component according to claim 1, further comprising an urging member, wherein said movable member further includes an urged portion for receiving an urging force from the urging member to rotate the movable member toward the open position when the movable member is situated within a specific range, and said urged portion is arranged to receive the urging force from the urging member to rotate the movable member toward the close position when the movable member is situated outside the specific range.

4. The electrical connector assembled component according to claim 1, wherein said movable member includes the engaging portion at a specific location so that the engaging portion engages with the engaged portion after the engaged portion passes the engaging portion through the passing allowing space when the flat conductive member is inserted into the receiving portion and the movable member is rotated toward the close position.

5. The electrical connector assembled component according to claim 1, wherein said engaging portion includes an engaging surface for engaging with the engaged portion when the movable member is situated at the close position, and said engaging surface is inclined so that the engaged portion is moved away from the passing allowing space along the engaging surface when the engaging surface engages with the engaged portion.

6. The electrical connector assembled component according to claim 1, wherein said pressure receiving portion includes a pressure receiving surface for abutting against the engaged portion when the movable member is situated at the open position, and said pressure receiving surface is inclined so that the engaged portion is moved toward the passing allowing space along the pressure receiving surface when the pressure receiving surface abuts against the engaged portion.

* * * * *